US007470083B2

(12) United States Patent
Black

(10) Patent No.: US 7,470,083 B2
(45) Date of Patent: Dec. 30, 2008

(54) METHOD AND APPARATUS FOR MAKING A SLOPED SURFACE

(76) Inventor: Kenneth R. Black, 13213 Moran Dr., Tampa, FL (US) 33618

( * ) Notice: Subject to any disclaimer, the term of this patent is extended or adjusted under 35 U.S.C. 154(b) by 0 days.

(21) Appl. No.: 11/575,976

(22) PCT Filed: Sep. 28, 2005

(86) PCT No.: PCT/US2005/035002

§ 371 (c)(1),
(2), (4) Date: Mar. 26, 2007

(87) PCT Pub. No.: WO2006/039397

PCT Pub. Date: Apr. 13, 2006

(65) Prior Publication Data

US 2007/0256393 A1 Nov. 8, 2007

(51) Int. Cl.
*E01C 19/22* (2006.01)

(52) U.S. Cl. ..... 404/97; 404/96; 404/118

(58) Field of Classification Search ..... 404/96, 404/97, 112, 118, 119, 120; 15/235.4, 235.8; 425/458

See application file for complete search history.

(56) References Cited

U.S. PATENT DOCUMENTS 1,021,927 A 4/1912 Harrison
2,090,959 A * 8/1937 Jackson ..... 405/268
2,435,052 A 1/1948 Parrett
3,208,361 A * 9/1965 Bidwell ..... 404/96
3,368,466 A * 2/1968 Rowe ..... 404/119
3,418,902 A * 12/1968 Wilson ..... 404/96
3,593,627 A * 7/1971 Rowe et al. ..... 404/119
3,798,868 A 3/1974 Laranger
4,115,976 A 9/1978 Rohrer
4,484,834 A * 11/1984 Rowe et al. ..... 404/84.8
4,699,543 A * 10/1987 Mio et al. ..... 404/109
5,468,095 A * 11/1995 Dawson ..... 404/118
6,386,793 B1 * 5/2002 Lenz et al. ..... 404/96
7,296,948 B2 * 11/2007 Mikhaylenko ..... 404/118

FOREIGN PATENT DOCUMENTS

CH 673308 A5 2/1990

* cited by examiner

*Primary Examiner*—Gary S Hartmann
(74) *Attorney, Agent, or Firm*—Peter J. Rashid

(57) ABSTRACT

An apparatus (10) for creating a sloped surface comprising at least one leveling member (12) and at least one guide member (36) for guiding the at least one leveling member (12). The at least one leveling member (12) changes the slope of the surface depending on a distance between a point of low elevation (54) to a point of higher elevation as the at least one leveling member (12) travels across the at least one guide member (36).

13 Claims, 4 Drawing Sheets

METHOD AND APPARATUS FOR MAKING A SLOPED SURFACE

TECHNICAL FIELD

The present invention generally relates to creating a sloped surface and in particular, to creating a sloped shower stall floor.

BACKGROUND OF THE INVENTION

Skilled craftsmen can build a shower floor or other sloped concrete surface so that the floor slopes toward a drain. However, reproducing the same slope every time is difficult. As a result, some shower floors are sloped a little too steeply and some shower floors aren't sloped enough. If the shower floor is too steep, the person using the shower may feel uncomfortable standing in the shower. A floor that is not steep enough drains poorly.

Due to the difficult nature of sloped concrete floor construction, skilled craftsmen in the field charge a premium for their work. Therefore, there is a need for a construction technique that would consistently produce shower floors having an ideal slope while at the same time reducing the cost of such floors.

SUMMARY OF THE INVENTION

An apparatus for creating a sloped surface comprising at least one leveling member and at least one guide member for guiding the at least one leveling member. The at least one guide member provides a predetermined height for the sloping surface, and wherein the at least one leveling member changes the slope of the surface depending on a distance between a point of low elevation to a point of higher elevation as the at least one leveling member travels across the at least one guide member.

DETAILED DESCRIPTION

Figure 1:
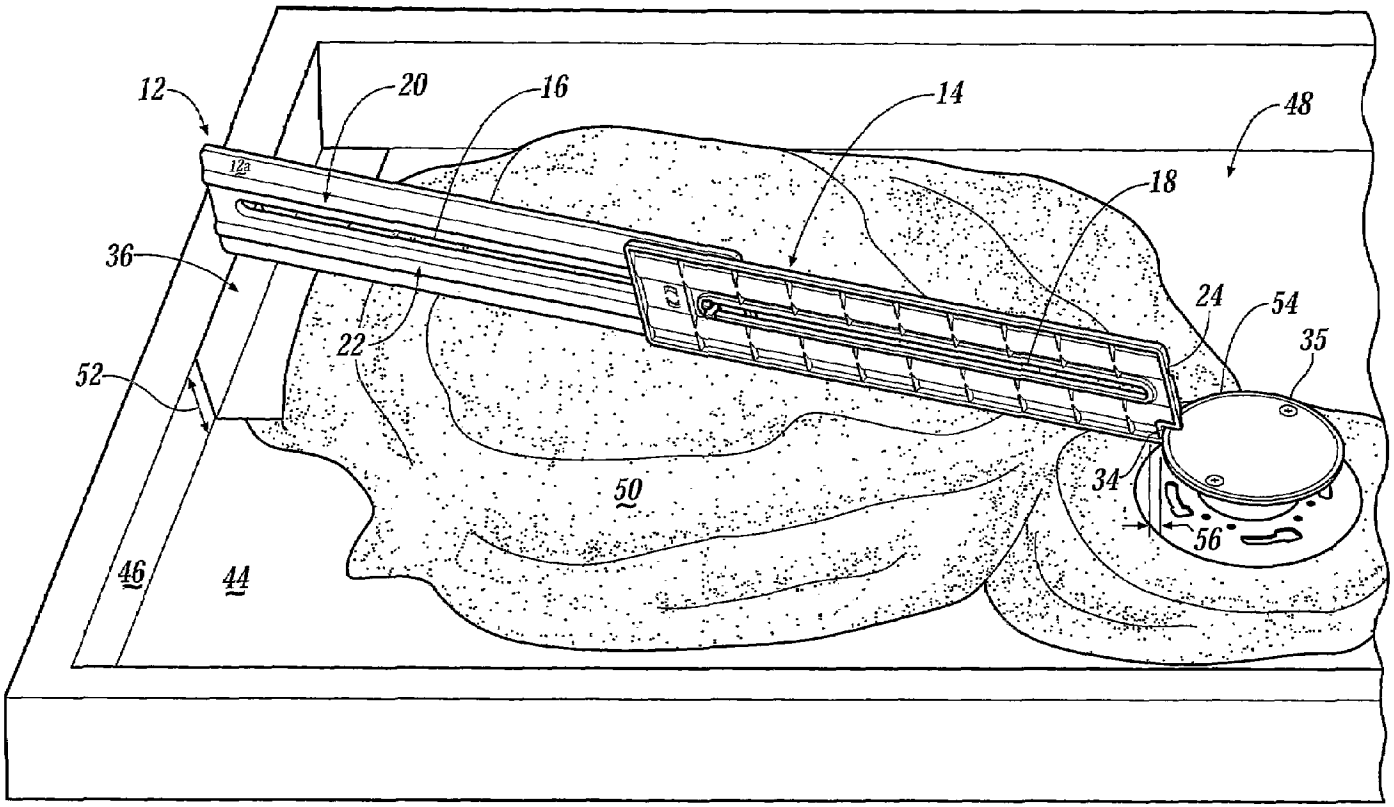
FIG. 1 is a perspective view of an apparatus for making a sloped surface, in a shower stall, according to an embodiment of the present invention.
Figure 2:
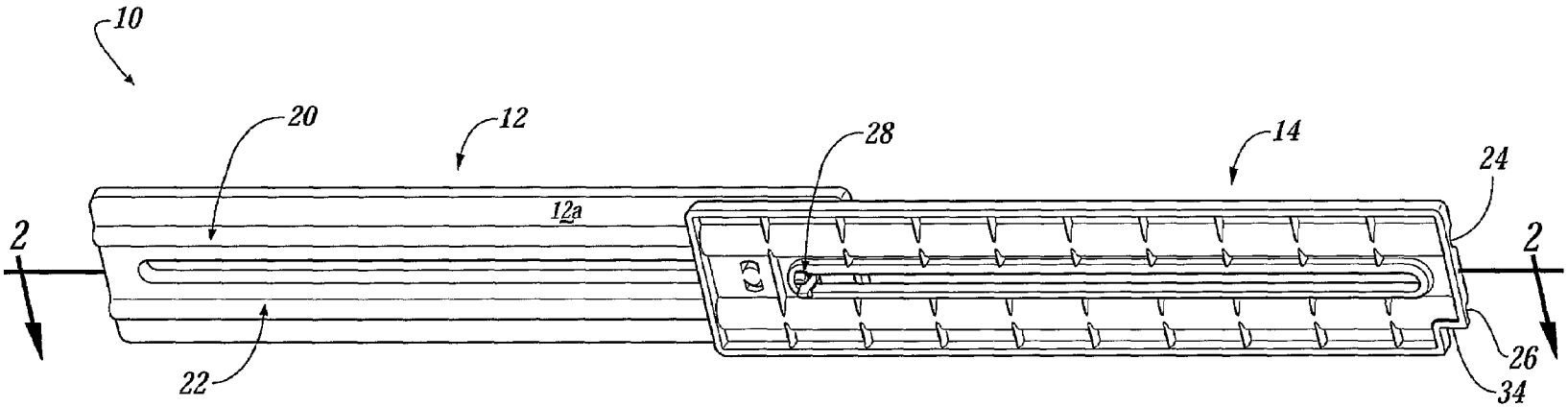
FIG. 2 is a perspective view of the apparatus for making a sloped surface in an extended position according to an embodiment of the invention.
Figure 3:
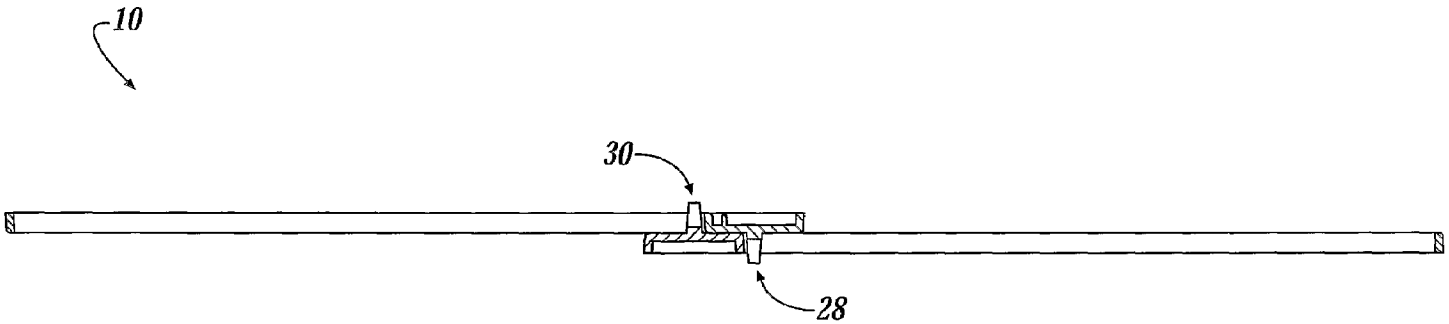
FIG. 3 is a cross-sectional view of the apparatus for making a sloped surface taken along line 3-3 of FIG. 2 according to an embodiment of the invention.
Figure 4:
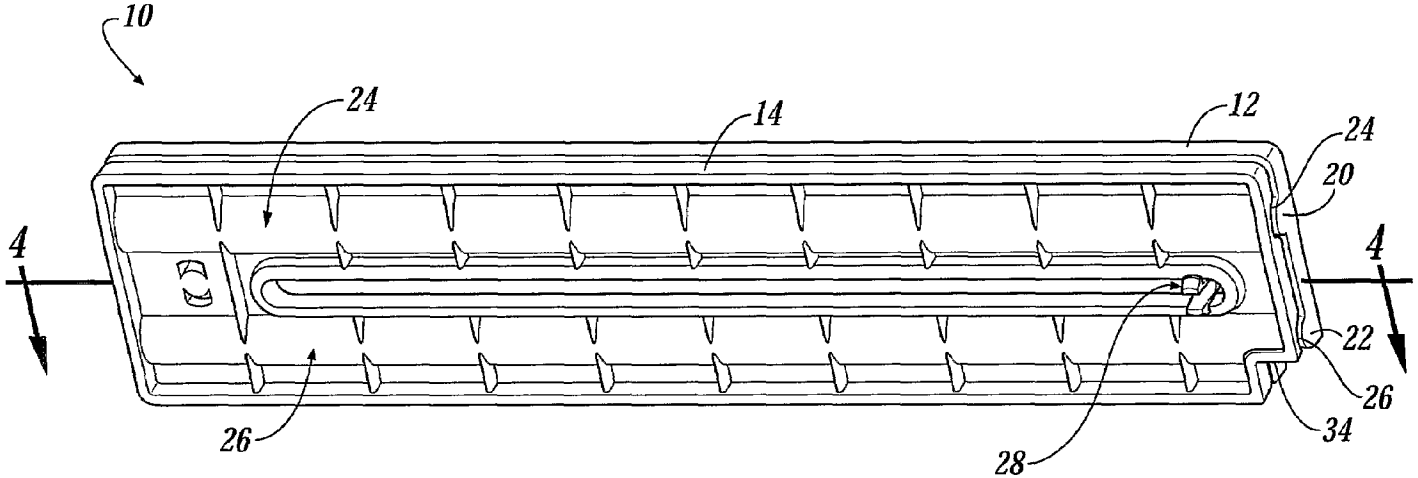
FIG. 4 is a perspective view of the apparatus for making a sloped surface in a retracted position according to an embodiment of the invention.
Figure 5:
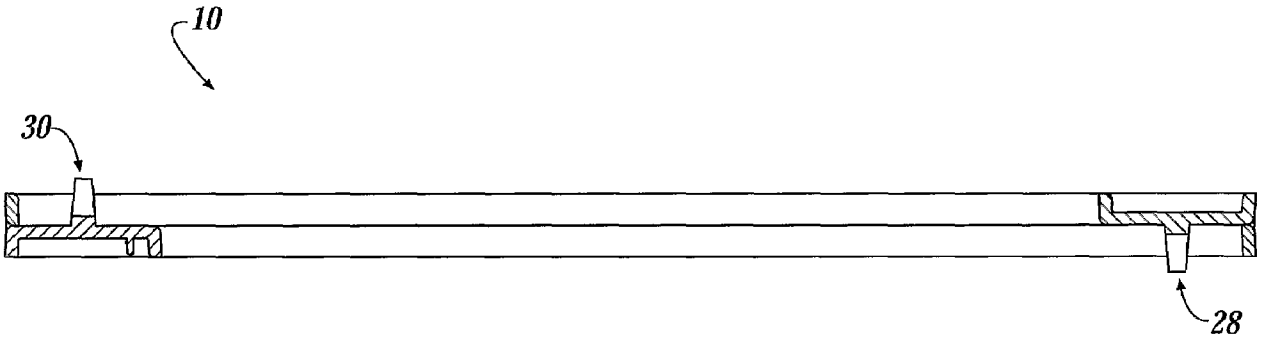
FIG. 5 is a cross-sectional view of the apparatus for making a sloped surface taken along line 5-5 of FIG. 4 according to an embodiment of the invention.

The invention is directed towards creating a sloped surface. As the apparatus of the invention travels along a guide member, a smooth surface is created. Additionally, the slope of the surface varies depending on the distance between the lowest point of elevation and the guide members. One application of the invention is the manufacturing of a sloped shower stall floor, as described in detail below.

Referring to the Figures, an apparatus for making a sloped surface, floor or the like, is generally shown at 10 according to an embodiment of the invention. The apparatus 10 includes one or more leveling members, for example, a first leveling member 12 and a second leveling member 14 and at least one guide member 36. The leveling members 12, 14 may be any type of conventional device for leveling pre-hardened cement, such as, for instance, screed boards, or the like. For example, the leveling members 12, 14 may be formed from a material having sufficient rigidity such that the members 12, 14 are capable of leveling pre-hardened cement. The first and second leveling members 12, 14 may be made from a number of materials, including wood, plastic, metal, hardened acrylic, a galvanized material, or the like. As illustrated, the apparatus 10 includes two leveling members, however, it can be appreciated that the invention may be practiced with any number of leveling members. As described in further detail below, the leveling members 12 and 14 are slidingly mounted to one another such that the length of the apparatus 10 may be expanded or contracted to a desired length, as illustrated in FIGS. 2-5.

In the illustrated embodiment of the invention, for instance, the first leveling member 12 has an approximate length of 10" and the second leveling member 14 has an approximate length of 18". However, leveling members 12, 14 may be of the same length, or may be of a longer or shorter length, depending upon the size of the floor. It can be further appreciated that the invention is not limited by the length of leveling members 12, 14 and may be practiced with leveling members 12, 14 of any desired length.

The first leveling member 12 includes a slot 16 located proximately along the middle of the width of the first leveling member 12. The second leveling member 14 includes a slot 18 located along the middle of the width of the second leveling member 14. Both slots 16, 18 extend across a substantial portion of the length of leveling members 12, 14 and have a diameter 19. As illustrated, slots 16, 18 have corresponding lengths and diameters. However, it can be appreciated that the leveling members 12, 14 may have any desired number of slots of any desired length and diameter.

Figure 7:
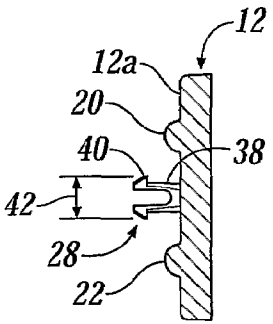
FIG. 7 is a cross-sectional view of the primary leveling member taken along line 7-7 of FIG. 6 according to an embodiment of the invention.
Figure 6:
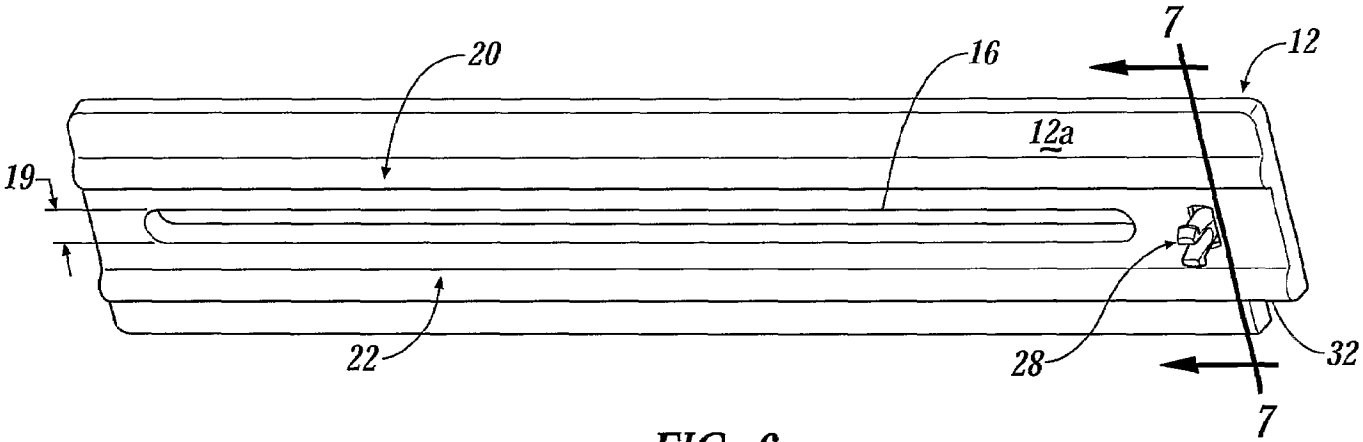
FIG. 6 is a perspective view of a primary leveling member of the apparatus for making a sloped surface according to an embodiment of the invention.

The first leveling member 12 includes two rails, protrusions, or the like, 20, 22 extending outwardly from a surface 12*a* of the first leveling member 12. In the illustrated embodiment, the rails 20, 22 are located approximately ⅜" from the top and bottom edges, respectively, of first leveling member 12, and extend outwardly approximately 1/16" to ⅛" from surface 12*a* of first leveling member 12. FIGS. 6 and 7 illustrates rails 20, 22 extending outwardly from surface 12*a* of first leveling member 12.

Figure 9:
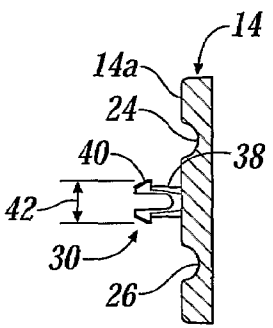
FIG. 9 is a cross-sectional view of the secondary leveling member taken along line 9-9 of FIG. 8 according to the alternate embodiment of the invention.
Figure 8:
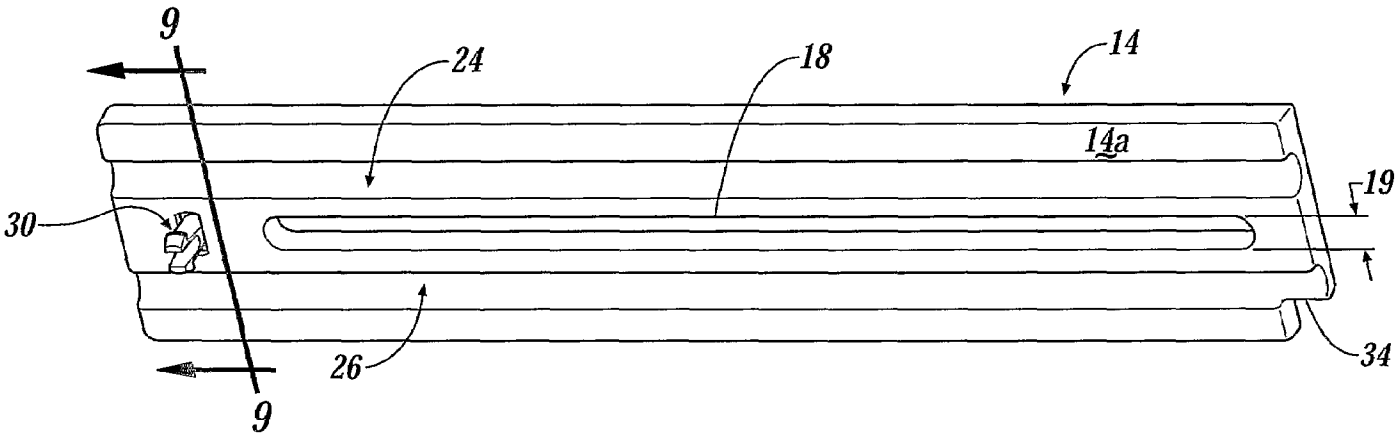
FIG. 8 is a perspective view of a secondary leveling member of the apparatus for making a sloped surface according to an embodiment of the invention.

Second leveling member 14 includes two grooves, indents, or the like, 24, 26 extending inwardly from a surface 14*a* of second leveling member 14. In the illustrated embodiment, grooves 24, 26 are located approximately ⅜" from the top and bottom edges, respectively, of second leveling member 14, and extend inwardly approximately 1/16" to ⅛" from surface 14*a* of second leveling member 14. FIGS. 8 and 9 illustrate grooves 24, 26 extending inwardly from surface 14*a* of second leveling member 14.

Rails 20, 22 and grooves 24, 26 provide a track in which leveling members 12, 14 may follow to expand or contract apparatus 10. While rails 20, 22 and grooves 24, 26 are illustrated as being arcuate in shape, it can be appreciated that rails 20, 22 and grooves 24, 26 may be any shape so long as rails 20, 22 and grooves 24, 26 correspond in shape. It can be further appreciated that rails 20, 22 of first leveling member 12 and grooves 24, 26 of second leveling member 14 may be located anywhere along leveling members 12, 14 respectively, and may be of any desired dimension, so long as grooves 24, 26 can engage rails 20, 22 when first leveling member 12 and second leveling member 14 are placed adjacent one another. It can be further appreciated that the invention may be practiced with any desired number of rails and grooves, so long as each rail has a corresponding groove.

Leveling members 12, 14 each further include at least one tee lock 28, 30 located proximate to slots 16, 18. Tee locks 28, 30 comprise a stem 38 which extends outwardly from surfaces 12*a*, 14*a* of leveling members 12, 14, respectively, and a flange portion 40 attached to stem 38. Flange portion 40 has a diameter 42 which is greater than the diameter 19 of slots 16, 18. Stem 38 may be flexible, such that when compressed, the diameter 42 of flange portion 40 decreases. It can be appreciated that tee locks 28, 30 may be manufactured integrally to leveling members 12, 14 or may be secured to leveling members 12, 14 during a secondary manufacturing process. It can be further appreciated that stem 38 may be any desired length, so long as, flange portion 40 extends past leveling members 12, 14 respectively, when first leveling member 12 and second leveling member 14 are placed adjacent one another.

Apparatus 10 may be assembled by placing the first leveling member 12 over the second leveling member 14 such that slot 16 of the first leveling member 14 and slot 20 of the second leveling member are aligned and surface 12*a* of leveling member 12 abuts surface 14*a* of leveling member 14. Accordingly, rails 20, 22 may slidingly engage grooves 24, 26 and tee locks 28, 30 may slidingly engage slots 16, 18 of leveling members 12, 14, respectively. When tee locks 28, 30 engage slots 16, 18, stem 38 and flange portion 40 are compressed together such that the diameter 42 of flange portion 40 is smaller than the diameter 19 of slots 16, 18, thereby allowing passage of tee locks 28, 30 through slots 16, 18, respectively. After tee lock 28 passes through slot 18 and tee lock 30 passes through slot 16, flange portion 40 returns to diameter 42. Thus, tee locks 28, 30 prevent leveling members 12, 14 from disassembling during use.

The first leveling member 12 further includes a notch 32 cut out of one corner of the first leveling member 12. The second leveling member 14 includes a notch 34 cut out of a one corner of the leveling member 14. Depending upon the desired length of the apparatus 10 and the number of leveling members utilized, either notch 32 or 34 operatively engages the adjustable leveling member system 10 to a drain 35 of the shower stall.

The apparatus 10 further includes one or more guide members 36. The guide members 36 are placed along the periphery of floor 44 and abut walls 46 of shower stall 48. For illustrative purposes only, FIG. 1 includes a partial guide member 36 located adjacent to a wall 46 of the shower stall 48. In the illustrated embodiment, guide member 36 is an "L" beam rail, although other cross-sectional shapes can be practiced with the invention. The "L" cross-sectional shape of guide member 36 allows guide member 36 to be free standing and to be firmly secured to floor 44 of shower stall 48 after a material 50 for floor 44 has been poured. The guide members 36 provide floor 44 with a uniform, predetermined height 52 along the periphery of shower stall 48. For example, the predetermined height 52 is approximately 2 inches. As a result, when tiles are mounted to walls 46 of shower stall 48, the bottom tiles form a straight line around the periphery of shower stall 48. It should be noted that the invention may be practiced with guide members 36 of any cross-sectional shape, so long as guide members 36 provide floor 44 with a desired, predetermined height along the periphery of shower stall 48. In one example, the predetermined height 52 may be substantially constant along the periphery of floor 44. In another example, the predetermined height 52 may change or vary along the periphery of floor 44.

The apparatus 10 can create a uniformly sloped floor 44. Initially, the guide members 36 are placed along the periphery of the shower stall floor. Afterwards, material 50 for floor 44 is poured into shower stall 48 covering a portion of guide members 36. Conventionally, shower stall floors are made from "mud", concrete or the like.

Thereafter, notch 34 operatively engages a point of low elevation, such as, for example, an outer lip 54 of drain 35. Apparatus 10 projects radially from drain 35 to a point of higher elevation, such as, the top of guide members 36, as shown in FIG. 1. The apparatus 10 is then moved or rotated around the circumference of outer lip 54 of drain 35 and along the top of guide members 36. As apparatus 10 travels around drain 35, leveling members 12, 14 are guided by the guide members 36 to level material 50 of floor 44. The slope of floor 44 may vary between drain 35 and shower stall walls 46 depending on the distance between outer lip 54 of drain 35 and guide members 36 positioned along the periphery of floor 44. For example, as illustrated in FIG. 1, the slope of floor 44 will vary as the apparatus 10 moves from one corner of the floor to another corner of the floor because the distance between outer lip 54 of drain 35 and guide members 36 varies. However, if the shower stall 48 is substantially circular, apparatus 10 may be able to form a substantially uniform sloped surface 44. In addition, apparatus 10 also accounts for instances when drain 35 is not substantially level, and will automatically change the slope of surface 44, as leveling members 12, 14 travel across guide members 36. Additionally, notch 32 or 34 provides a distance 56 between outer lip 54 of drain 35 and material 50 for the floor 44 so that the tile installed for floor 44 is substantially flush with outer lip 54 of drain 35.

The apparatus 10 is particularly useful for manufacturing custom shower stalls, where the size and shape of the shower stall may vary drastically from standard rectangular or square shower stalls. When manufacturing the custom shower stall, the apparatus 10 may include members that vary in length according to the size and shape of the floor of the custom shower stall.

The embodiments disclosed herein have been discussed for the purpose of familiarizing the reader with novel aspects of the invention. Although preferred embodiments of the invention have been shown and described, many changes, modifications and substitutions may be made by one having ordinary skill in the art without necessarily departing from the spirit and scope of the invention as described in the following claims.

The invention claimed is:

1. An apparatus (10) for making a sloped surface having a point of lowest elevation and a point of highest elevation, the apparatus comprising:

a guide member (36) positioned about a periphery of a surface, the guide member (36) having a top surface; and a leveling member (12, 14) comprising a first leveling member (12) and a second leveling member (14) slidingly mounted to each other in a telescoping arrangement such that the leveling member (12, 14) has a selectively adjustable length, one end of the first leveling member (12) positioned at the point of lowest elevation of the surface, and one end of the second leveling member (14) resting on the top surface of the guide member (36) to define a point of highest elevation of the surface; and wherein the leveling member (12, 14) varies a slope of the surface (44) depending on a distance between the point of lowest elevation (54) and the point of highest elevation as the leveling member (12) travels along the top surface of the guide member (36).

2. An apparatus (10) according to claim 1, wherein the guide member (36) provides the surface (44) with a predetermined height (52) along the periphery of the surface (44).

3. An apparatus (10) according to claim 1, wherein the first and second leveling members (12, 14) include a slot (16) and a tee lock (28), wherein the tee lock (28) of the first leveling member (12) slidingly engages the slot (18) of the second leveling member (14), and the tee lock (30) of the second leveling member slidingly engages the slot (16) of the first leveling member (12), thereby slidingly mounting the first and second leveling members (12, 14) together.

4. An apparatus (10) according to claim 1, wherein the first leveling member (12) includes a plurality of protrusions (20, 22) extending outwardly from the first leveling member (12), the second leveling member (14) includes a plurality of grooves (24, 26) extending inwardly from the second leveling member (14), and wherein the plurality of protrusions (20, 22) slidingly engage the plurality of grooves (24, 26) when the first and second leveling members (12, 14) are slidingly mounted together.

5. An apparatus (10) according to claim 1, wherein the at least one leveling member (12) includes a notch (32) for engaging the point of lowest elevation (54) as the leveling member (12) travels along the guide member (36).

6. An apparatus (10) according to claim 1, wherein the guide member (36) is an "L" beam rail having an L cross-sectional shape.

7. A method of manufacturing a sloped surface, comprising the steps of:

positioning a guide member (36) along a periphery of a surface;

positioning a leveling member (12, 14) having a selectively adjustable length such that the leveling member (12, 14) extends radially from a point of low elevation of a surface (44) to a point of higher elevation of the surface (44); and moving the leveling member (12, 14) along the guide member (36), whereby the leveling member (12, 14) varies a slope of the surface (44) depending on a distance between the point of low elevation and the point of higher elevation as the leveling member (12, 14) moves along the guide member (36).

8. An apparatus (10) for making a sloped surface of a floor (44), comprising:

a guide member (36) located about an outer periphery of the floor (44), the guide member (36) having a top surface; and a leveling member (12, 14) comprising a first leveling member (12) and a second leveling member (14) slidingly mounted to each other in a telescoping arrangement such that the leveling member (12, 14) has a selectively adjustable length in a radial direction between a drain (35) located in a central portion of the floor (44) defining a point of low elevation, and the top surface of the guide member (36) defining a point of higher elevation, one end of the first leveling member (12) engaging the drain (35), and one end of the second leveling member (14) resting on the top surface of the guide member (36);

wherein the leveling member (12, 14) varies a slope of the floor (44) depending on a distance between the drain (35) and the guide member (36) as the leveling member (12) travels along the top surface of the guide member (36).

9. An apparatus (10) according to claim 8, wherein the guide member (36) provides the surface (44) with a predetermined height (52) along the outer periphery of the floor (44).

10. An apparatus (10) according to claim 8, wherein the first and second leveling members (12, 14) include a slot (16) and a tee lock (28), wherein the tee lock (28) of the first leveling member (12) slidingly engages the slot (18) of the second leveling member (14), and the tee lock (30) of the second leveling member slidingly engages the slot (16) of the first leveling member (12), thereby slidingly mounting the first and second leveling members (12, 14) together.

11. An apparatus (10) according to claim 8, wherein the first leveling member (12) includes a plurality of protrusions (20, 22) extending outwardly from the first leveling member (12), the second leveling member (14) includes a plurality of grooves (24, 26) extending inwardly from the second leveling member (14), and wherein the plurality of protrusions (20,22) slidingly engage the plurality of grooves (24, 26) when the first and second leveling members (12, 14) are slidingly mounted together.

12. An apparatus (10) according to claim 8, wherein the at least one leveling member (12) includes a notch (32) for engaging the drain (35) as the leveling member (12) travels along the guide member (36).

13. An apparatus (10) according to claim 8, wherein the guide member (36) is an "L" beam rail having an L cross-sectional shape.

* * * * *